US005464207A

United States Patent [19]

Boitano

[11] Patent Number: 5,464,207

[45] Date of Patent: Nov. 7, 1995

[54] BREAK-AWAY BASKETBALL GOAL

[75] Inventor: Robert A. Boitano, St. Louis, Mo.

[73] Assignee: Gared Sports, Inc., St. Louis, Mo.

[21] Appl. No.: 148,358

[22] Filed: Nov. 8, 1993

[51] Int. Cl.[6] ..... A63B 63/08

[52] U.S. Cl. ..... 273/1.5 R

[58] Field of Search ..... 273/1.5 R, 1.5 A; 172/263–269; 248/573, 574

[56] References Cited

U.S. PATENT DOCUMENTS

| | | | |
|---|---|---|---|
| 275,146 | 4/1883 | Clark | 172/265 X |
| 1,808,478 | 6/1931 | Printz | 172/269 |
| 2,304,421 | 12/1942 | Rogers | 172/269 X |
| 2,331,686 | 10/1943 | Hintz, Jr. | 172/269 |
| 4,433,839 | 2/1984 | Simonseth | 273/1.5 R |
| 4,438,923 | 3/1984 | Engle et al. | 273/1.5 R |
| 4,441,709 | 4/1984 | Schroeder et al. | 273/1.5 R |
| 4,534,556 | 8/1985 | Estlund et al. | 273/1.5 R |
| 4,575,079 | 3/1986 | De Faveri | 273/1.5 R |
| 4,583,732 | 4/1986 | Allen | 273/1.5 R |
| 4,676,503 | 6/1987 | Mahoney et al. | 273/1.5 R |
| 4,799,679 | 1/1989 | Obram | 273/1.5 R |
| 4,846,469 | 7/1989 | Nye | 273/1.5 R |
| 5,066,007 | 11/1991 | Niver | 273/1.5 R |
| 5,071,120 | 12/1991 | Dadbeh | 273/1.5 R |
| 5,106,084 | 4/1992 | Vaught | 273/1.5 R |
| 5,154,414 | 10/1992 | Auer et al. | 273/1.5 R |

FOREIGN PATENT DOCUMENTS 3610815 1/1987 Germany .

9300136 7/1993 WIPO .

OTHER PUBLICATIONS

1990–1991 Gared Sports, Gared Sports, Inc., Catalog pp. 2–3, Snap Back Rim.

The Guardian Glass Backboard., The Slam–Dunk Reflex Rim with Hercules Construction Slam Dunk Rim, Inc., Get Rid of Those Slam—Dunk Blues!

*Primary Examiner*—Paul E. Shapiro

*Attorney, Agent, or Firm*—Kalish & Gilster

[57] ABSTRACT

A basketball goal for use with a basketball backboard having a front surface has a rigid annular rim which is normally disposed horizontally during play and a rigid metal plate fixed to the rigid annular rim and extending rearwardly therefrom in coplanar relationship thereto. The goal includes a mounting bracket having at least a back wall and a top wall mounted on the front surface of the backboard by the backwall and pivotally connected to the rigid metal plate. The rigid metal plate is pivotally connected to the bracket to thereby permit the rigid metal plate and rigid annular rim fixed thereto to pivot in relation to the backboard. The releasable latching mechanism is rollably interconnected to the rigid metal plate and to the mounting bracket and permits tilting of the rigid annular rim from the normally horizontal play position thereof only when force of at least a certain preselected amount is placed upon the rigid annular rim. The rigid annular rim immediately returns to the normal horizontal play position after the latching means has been released and the force causing such release has been removed.

13 Claims, 3 Drawing Sheets

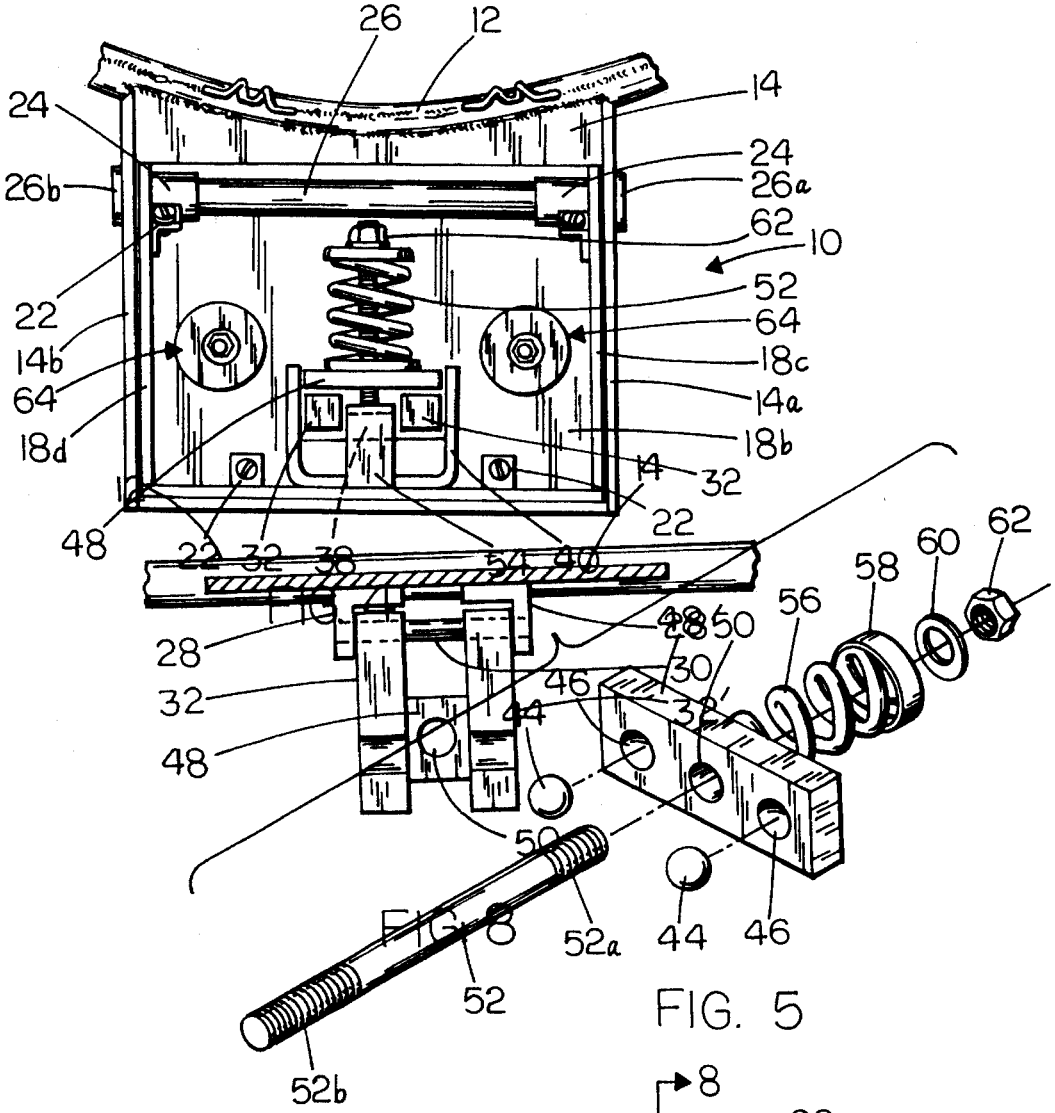
FIG. 8
FIG. 5
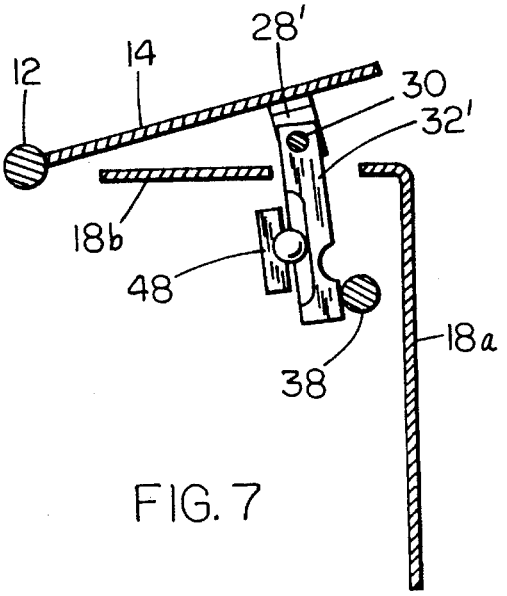
FIG. 7
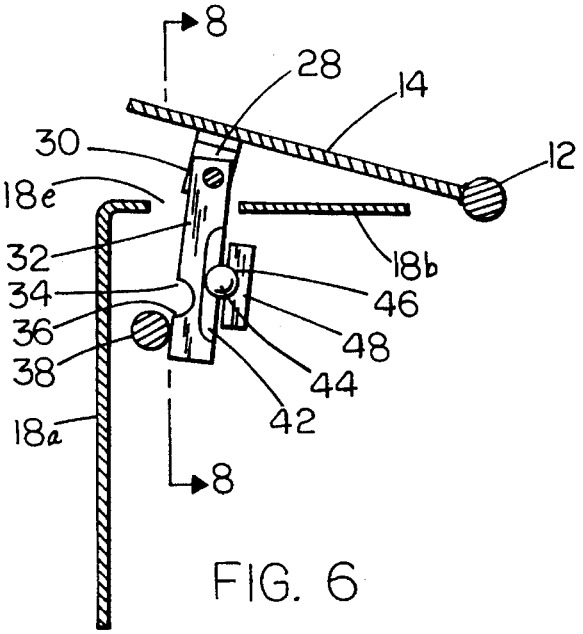
FIG. 6

BREAK-AWAY BASKETBALL GOAL

BACKGROUND AND SUMMARY OF THE INVENTION

The present invention relates generally to the field of basketball goals, and, more particularly, to a new break-away basketball goal which has a roller bearing and detent latching mechanism which permits release of the rim when sufficient pressure is applied, and which structure prevents wear of the critical parts even under very heavy usage.

It is well known that during play of the game of basketball the rim or hoop portion of the goal may encounter a great deal of force from contact with a player's hand or arm as a ball is passed through the rim. It is not uncommon with older goals for the backboard to which the goal is attached to break, or for the goal rim to bend or parts thereof to separate during especially aggressive play. Of course, shattering of a glass backboard presents a certain amount of danger to the players and any sort of equipment breakage represents unwelcome expense to the relevant civic group, school or other owner organization or individual. Thus, many basketball goal structures have been developed to address this problem, with various degrees of success.

Previously, break-away basketball goals have been known which permit at least the rim portion of the goal to shift or "give" under sufficient downward pressure in order to avoid breakage or bending of the goal, backboard, or associated parts. It is to be understood that by "break-away" it is meant that the rim drops in a hinged fashion from the normal horizontal play position, but does not completely separate from its connection to the backboard of the goal.

Some goals have been known in which the rim portion will release downwardly to some extent upon application of a specific amount of force, and then the rim will return to its normally horizontal position for continued play. However, repetition of this cycle for any appreciable length of time will ordinarily cause wear of the latching mechanism which retains the rim in its normal place, and ultimately will result in sloppiness or "Play" in the structure, to the extent that the rim is not truly horizontal during play, or fails to return to play position altogether.

Sufficient degeneration of the latching structure may cause the basketball goal to fail to meet specific standards which are necessary for protection of the players, as well as for even-handedness, and are sometimes required, for example, by the National Basketball Association, for professional basketball teams, or by various school athletic associations. The present break-away goal features a new latching mechanism with a rolling ball and detent structure which will permit heavy usage for a great deal of time without noticeable wear of any critical parts.

Accordingly, it is among the several objects of the present invention to provide a basketball goal in which the rim portion can partially "break-away" from the backboard under a preselected amount of pressure and immediately thereafter return to its normal play position.

It is also among the objects of the present invention that the basketball goal having the features indicated be structured, and capable of being adjusted if necessary, in order to meet certain standards, for example for positioning and release pressure, that may be set by an organization for regulation of play under the organization's rules.

It is further among the objects of the present invention that the new basketball goal be capable of cycling through an unusually large number of releases and returns to normal play position without encountering a noticeable degree of wear of the parts forming the structure for release and return of the basketball goal rim.

Accordingly, in furtherance of the above objects, the present invention is, briefly, a basketball goal for use with a basketball backboard having a front surface, the basketball goal including a rigid annular rim which is normally disposed horizontally during play, a rigid metal plate fixed to the rigid annular rim and extending rearwardly therefrom in coplanar relationship thereto. The goal also includes a mounting bracket having at least a back wall and a top wall mounted on the front surface of the backboard by the backwall and pivotally connected to the rigid metal plate. A mechanism is provided for pivotally connecting the rigid metal plate to the bracket to thereby permit the rigid metal plate and rigid annular rim fixed thereto to pivot in relation to the backboard. A releasable latching mechanism is connected to the rigid metal plate and connected to the mounting bracket, and which permits tilting of the rigid annular rim from the normally horizontal play position thereof only when force of at least a certain preselected amount is placed upon the rigid annular rim. The goal also has connectors for connecting the releasable latching mechanism to the rigid metal plate and for connecting the releasable latching mechanism to the mounting bracket and structure for causing immediate return of the rigid annular rim to the normal horizontal play position after the latching mechanism has been released and the force causing such release has been removed.

Furthermore, the invention is, briefly, in a basketball goal for use with a basketball backboard having a front surface, a rigid annular rim which is normally disposed horizontally during play, and mounting structure for mounting the rim in pivotal, yieldable relationship to the backboard, the improvement including, in combination, structure including a position defining member, for engagement of the mounting structure, for defining a normal horizontal configuration of the rim but permitting yieldable displacement from the horizontal configuration upon the rim receiving a predetermined vertical displacement force downwardly upon the rim. Also included is pressure applying structure for urging a preselected pressure against the position defining member to maintain the normal horizontal configuration of the rim while permitting the displacement of the rim for break-away movement upon it receiving the vertical displacement force, and a rolling contact mechanism for interengaging the pressure applying structure and the position defining member, whereby the preselected pressure upon the position defining member only through rolling contact assures that the rim will be yieldably displaced by the vertical displacement force to a very high degree of accuracy and repeatability.

Further objects will become in part apparent and in part pointed out hereinbelow.

BRIEF DESCRIPTION OF THE DRAWINGS

FIG. 4 is a partial bottom plan view of the basketball goal of FIG. 1.

FIG. 5 is an exploded view of portions of the latching mechanism of the basketball goal of FIG. 1.

FIG. 6 shows the structure of FIG. 3 in released position.

FIG. 7 is the same as FIG. 6, but taken from the opposite direction, longitudinally through the center of the second dog.

Throughout the drawings like parts are indicated by like element numbers.

DESCRIPTION OF THE PREFERRED EMBODIMENT

Figure 1:
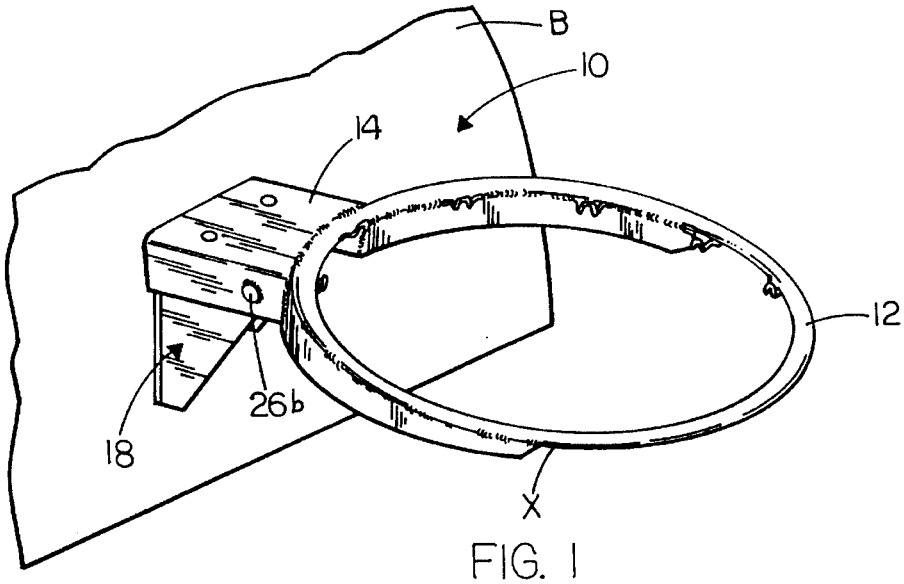
FIG. 1 is a perspective view of a basketball goal constructed in accordance with and embodying the present invention.

With reference to the drawings, and particularly FIG. 1, 10 generally designates a break-away basketball goal constructed in accordance with and embodying the present invention. Goal 10 is composed of a rigid, annular rim or hoop 12, a rearwardly extending rigid plate 14 welded to rim 12 and which is connected as described hereafter by a new latching mechanism 16 to a mounting bracket 18 by which goal 10 is mounted on a backboard B. Throughout the following description "forward" is intended to refer to the direction toward the front of the rim as it is facing a player, for example, during a free throw. "Rearward" is intended to mean the direction toward the backboard supporting the goal.

As seen in FIGS. 2, 3, 4 and 6, bracket 18 is preferably formed of plate metal so as to have a flat back wall 18*a* for flush connection via holes 20 and known connectors to a backboard. Back wall 18*a* of mounting bracket 18 extends upwardly until intersecting a usually flat top wall 18*b* to which it is rigidly fixed and which top wall extends perpendicularly forwardly from back wall 18*a* toward rim 12. Thus, top wall 18*b* is positioned horizontally, perpendicular in relation to the front surface of backboard B at all times. When rim 12 is in normal, horizontal position for play top wall 18*b* of bracket 18 is disposed beneath plate 14 and is disposed adjacent and substantially parallel thereto. Top wall 18*a* defines an opening 18*e* for passage therethrough of portions of latching mechanism 16 which are connected to rigid plate 14 as later described.

It is preferred that side walls 18*c*, 18*d* are angled so as not to create an obstacle, and are vertically disposed on mounting bracket 18, extending parallel to each other outwardly and perpendicularly from back wall 18*a* so that latching mechanism 16 is enclosed on each side thereby and beneath top wall 18*b*. A cover plate (indicated by the broken line at C in FIG. 3) may optionally be attached by connectors 22 to completely enclose latching mechanism 16 so as to prevent inadvertent and possibly harmful introduction of a player's fingers into the mechanism.

Figure 2:
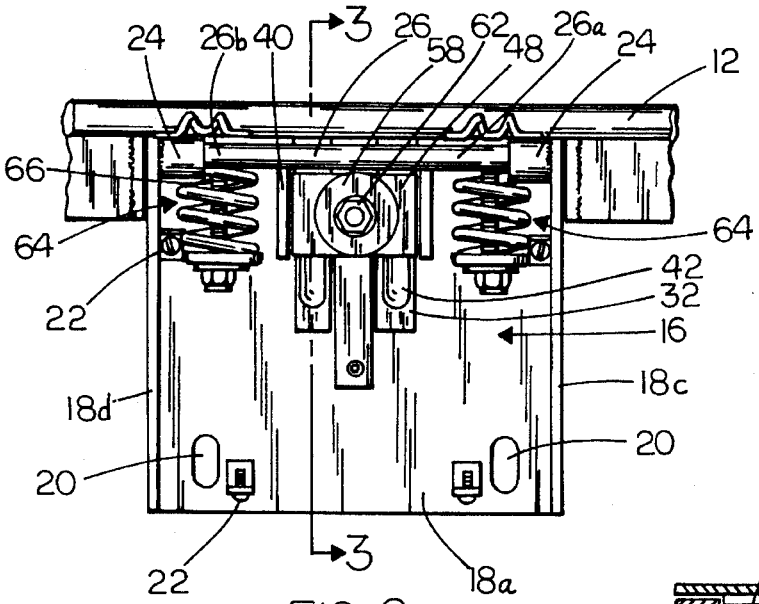
FIG. 2 is a partial front elevational view of the basketball goal of FIG. 1.

As shown in FIGS. 2 and 4, inwardly on each side wall 18*c*, 18*d* substantially at the forward end thereof is welded a bearing 24 for rotatably supporting therein a corresponding one of the two opposed ends 26*a*, 26*b* of a pivot shaft 26 which extends transversely and parallel just beneath top wall 18*b* of bracket 18. Plate 14 has depending, substantially vertical side flanges 14*a*, 14*b* which extend downwardly in parallel fashion adjacent to and outwardly, to the right and left of bracket walls. 18*c*, 18*d*, respectively. Shaft ends 26*a*, 26*b* rotatably penetrate side walls 18*c*, 18*d*, respectively, and corresponding flanges 14*a*, 14*b* and terminate outwardly of the flanges. So structured rim 12, as attached by rigid plate 14, can pivot on shaft 26 in relation to mounting bracket 18.

Figure 3:
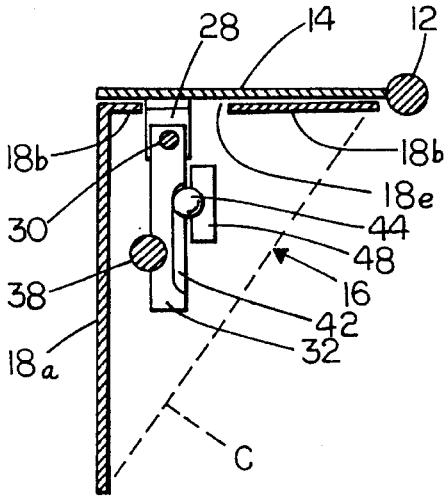
FIG. 3 is a sectional view taken on line 3—3 of FIG. 2 showing portions of the releasable latching mechanism of the goal in closed, normal play position.
Figure 8:
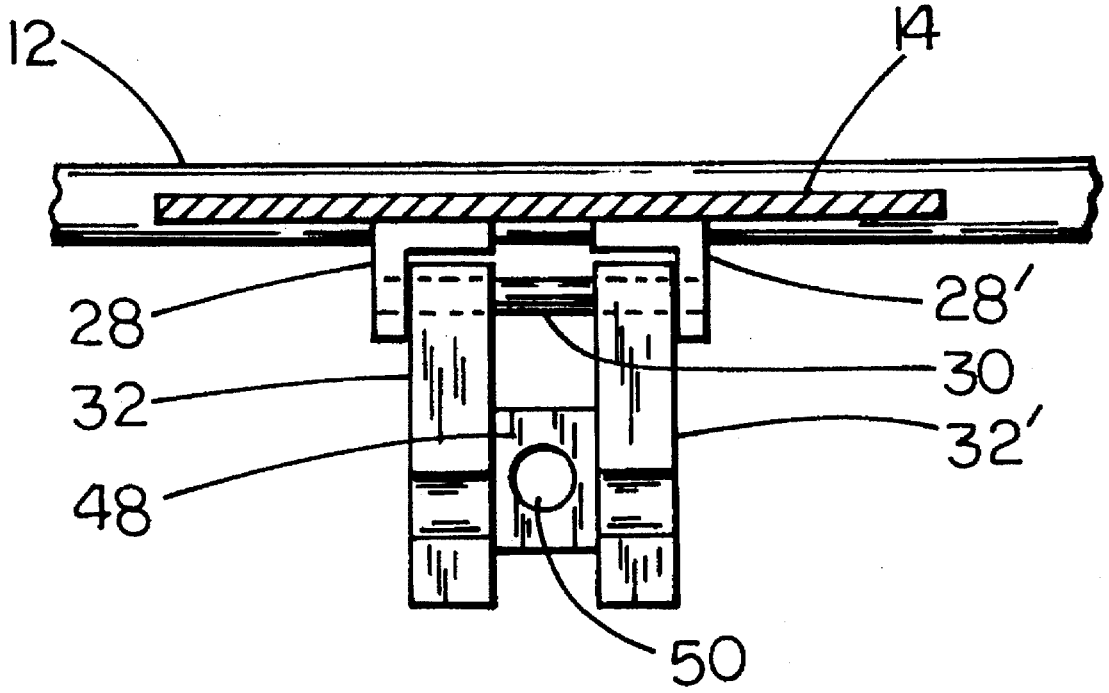
FIG. 8 is a sectional view of the goal of FIG. 1, taken on line 8—8 of FIG. 6.

With reference to FIGS. 3, 6 and 7, plate 14 has paired depending brackets 28, 28' fixed rearwardly on the lower surface thereof, spaced inwardly from back wall 18*a* to a sufficient distance that brackets 28, 28' can freely pass through opening 18*e* in top wall 18*b* of mounting bracket 18. Although two such depending brackets 28, 28' are preferred, more than two could be used. For example, a third such depending bracket 28, 28' could be centrally disposed on shaft 30, if necessary, or as an added strengthening feature. Brackets 28, 28' are transversely penetrated by a shaft 30 (seen in cross-section in FIGS. 3 and 6) upon which latching mechanism 16 can pivot as necessary during release and return of rim 12 by virtue of the following described structure.

Suspended downwardly from shaft 30 are spaced-apart paired dogs 32, 32' which are rotatably mounted at their upper ends on shaft 30 preferably outwardly of corresponding depending brackets 28, 28'. As shown in FIG. 6, each dog 32, 32' is provided on the elongated rearward (mounting bracket-facing) side thereof with a preferably semi-circular detent recess 34 which is formed transversely relative to the longitudinal axis of the dog and which is provided with a radius at its lower lip 36 machined to preferably three 32nds of an inch. Semi-circular recesses 34 function to receive a detent shaft 38 which is formed of hardened steel and fixed horizontally within a U-bracket 40 (FIG. 4), which is secured at its base portion to back wall 18*a* of mounting bracket 18 so that the parallel arms of U-bracket 40 open forwardly therefrom.

As seen most clearly in FIG. 6, when rim 12 encounters sufficient downwardly applied force (such as, for example, in the range of 180 to 230 pounds) to release latching mechanism 16, plate 14 tilts downwardly and forwardly, causing brackets 28 to lift upwardly through opening 18*e* along with the associated shaft 30 and upper ends of dogs 32, 32' which pivot slightly at their points of suspension therefrom. Simultaneously, detent recess 34 releases detent shaft 38 and slips upwardly past the shaft as radiused lip 36 slides thereover.

Dogs 32, 32' are each provided on their long, forward-facing sides with an elongated longitudinally machined groove or track 42 for rolling travel therein of a hardened steel ball bearing 44. Each ball bearing 44 is rollably housed in a preferably half-spherical or "cup-shaped" recess 46 of corresponding size formed in the rearwardly positioned face of a pressure plate 48. Ball recesses 46 are spaced apart from each other on pressure plate 48 to a sufficient extent as to align each of the two recesses with the machined groove or channel 42 in a corresponding dog 32, 32'.

As shown in FIG. 5, but omitted from FIGS. 3 and 6 for clarity, pressure plate 48 is centrally penetrated by an optionally threaded through-hole 50 which is sized for passage therethrough of a rod 52. With reference to FIG. 4, rod 52 may be either threaded or unthreaded (FIG. 5) on its central portion, but is preferably threaded at least on each of its two opposed ends 52*a*, 52*b*. Threaded end 52*b* adjustably engages a mounting block 54 fixed at the internal base of U-bracket 40 and shaft 52 extends from such point of engagement outwardly, through pressure plate 48, thereafter through a coil spring 56 and then desirably passes through an end cup 58, a washer 60, and is finally adjustably secured in position by an end nut 62 threadably engaged to forward shaft end 52*a*.

Thus, by movement of nut 62 on shaft end 52*a*, pressure may be applied or relieved from spring 56 and ultimately plate 48 so as to permit alteration of the amount of force required to overcome such pressure and cause latching mechanism 16 to disengage and release rim 12 so that it may move from its normal horizontal position. In so doing, pressure is applied through plate 48 against ball bearings 44 to maintain them in close contact as they roll in grooves 42 in corresponding dogs 32, 32' upon movement upwardly or downwardly of the dogs.

As shown in FIGS. 3 and 6, all parts of latching mechanism 16 stay in snug-fitting relationship as detent shaft 38 slips out of recesses 34 to release the rim. Detent shaft 38 then slips back into recesses 34 as rim 12 returns to normal horizontal play position under return force applied for example, by known paired coil spring assemblies 64 which are preferably disposed beneath top wall 8*b*.

With the above-described structure precise calibration of the pounds of force required to cause rim 12 to break-away can be readily accomplished by adjustment of nut 62 on rod 52 with only a minimal amount of training and use of a simple wrench or pair of pliers. Movement of nut 62 in turn causes movement of cup 58 against or away from spring 56, as the case may be, and ultimately against pressure plate 48 and dogs 32, 32' via ball bearings 44. This change in pressure on the parts of latching mechanism 16 results in a change in the amount of force required to be placed on rim 12 in order to overcome the latching mechanism pressure and to cause release of shaft 38 from detent recess 34, allowing rim 12 to tilt downwardly, rather than forcing breakage of bracket 18, rim 12 or the supporting backboard B.

Once set, this calibration is accurately maintained over the course of a great deal of use. To be assured of the accuracy of such calibration and reliability and durability of the described structure, professional testing was performed by a materials engineering and testing laboratory with the following results:

a. The hoop (rim) and return (latching) assembly sustained 31,000 cycles of 230 pound load applications with no metal failure and virtually no wear or deterioration of the moving components (bearings and dogs) in the return assembly.

b. The hoop returned to a horizontal position 0.0148 seconds after full release of downward restraining hook in test assembly. The hoop then rose above horizontal and requires an additional 0.0273 seconds to stabilize in normal horizontal position.

c. The maximum stress measured in the hoop was 44,221 psi tension at the point where the hoop reinforcement starts (indicated at X in FIG. 1).

d. No wear was identified on the left and right roller bearings. All diameters measured 0.4995 inches, which is identical to new ball diameter.

e. Microhardness readings of roller bearings showed cross-sectional, Rockwell C hardness of roller bearings average 63.2 RC (new), 62.0 RC (left), and 63.5 RC (right).

f. Rockwell hardness readings averaged 37 RC for left and right dogs. The original specifications specified hardness to be mid-40 RC range.

g. Photomicrographs revealed the grain structure of the left and right roller bearings, as well as a new roller bearing to be normal martensite structure.

h. Mechanical measurements of left and right dogs indicated a minimal wear of 0.001 inches in the area where the roller bearings contacted the surface of the dogs.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A basketball goal for use with a basketball backboard having a front surface, the basketball goal comprising a rigid annular rim which is normally disposed horizontally during play, a rigid metal plate fixed to the rigid annular rim and extending rearwardly therefrom in coplanar relationship thereto, a mounting bracket having at least a back wall by which it is connected to the front surface of the backboard and a top wall intersecting the back wall and extending forwardly therefrom, the mounting bracket being pivotally connected to the rigid metal plate, means for pivotally connecting the rigid metal plate to the mounting bracket to thereby permit the rigid metal plate and rigid annular rim fixed thereto to pivot in relation to the backboard, releasable latching means connected to the rigid metal plate and connected to the mounting bracket, and which permits forward tilting of the rigid annular rim from the normally horizontal play position thereof only when force of at least a certain preselected amount is placed downwardly upon a front portion of the rigid annular rim, means for connecting the releasable latching means to the rigid metal plate, means for connecting the releasable latching means to the mounting bracket, and means for causing immediate return of the rigid annular rim to the normal horizontal play position after the latching means has been released and the force causing such release has been removed.

2. The basketball goal of claim 1, wherein the rigid metal plate has a lower surface and the top wall of the mounting bracket extends horizontally outwardly relative to the front surface of the backboard upon which the mounting bracket is mounted parallel and beneath the lower surface of the rigid metal plate in the normally horizontal position thereof, the top wall of the mounting bracket defining an opening for passage therethrough of a portion of the latching means when the rigid annular rim is caused to tilt from its normally horizontal play position, and further wherein the means for connecting the releasable latching means to the rigid metal plate includes at least a first bracket and a second bracket fixed to and depending from the lower surface of the rigid metal plate in transversely spaced-apart relationship to each other, the first bracket and the second bracket extending downwardly through the opening defined by the top wall of the mounting bracket when the rigid annular rim is in the normal horizontal play position.

3. The basketball goal of claim 2, wherein the first bracket and the second bracket depending from the rigid metal plate each define a transverse opening, the opening in the first depending bracket and the opening in the second depending bracket being aligned with one another and sized for reception of a shaft, and further wherein the latching means includes a shaft received in the openings defined by the first depending bracket and the second depending bracket and extending therebetween, and a first elongated dog and a second elongated dog each having a first end and a second end, the first end of each dog being directed generally upwardly and the second end of each dog being directed generally downwardly, the shaft pivotally journalling at opposed ends thereof in the respective first ends of the first dog and the second dog, whereby the first elongated dog and the second elongated dog depend from and pivot freely upon the shaft received in the openings defined by first depending bracket and the second depending bracket when the rigid plate and the rim to which it is fixed tilt.

4. The basketball goal of claim 3, wherein the first elongated dog and the second elongated dog each have formed transversely on elongated, mounting bracket-facing sides thereof a detent recess for reception therein of a detent shaft, and further comprising a U-bracket horizontally fixed at a base thereof to the mounting bracket, the arms of the U-bracket opening outwardly therefrom and a detent shaft transversely fixed at opposed ends thereof to and within corresponding opposed arms of the U-bracket, spaced downwardly from the top wall of the mounting bracket and forwardly from the back wall of the mounting bracket sufficiently far in each direction so as to engage the detent recess formed in each of the first and second elongated dogs when the rigid plate and the rim fixed thereto are in normal horizontal position.

5. The basketball goal of claim 3, wherein the first elongated dog and the second elongated dog are each provided with an elongated longitudinal groove on respective forwardly facing sides thereof, and the releasable latching means further comprises first and second ball bearings rollably engaging the first elongated groove and the second elongated groove, respectively, and a pressure plate adjustably disposed forwardly of the first elongated dog and the second elongated dog, transversely in relationship thereto, the pressure plate having first and second ball recesses formed in a dog-facing side thereof in transversely spaced apart relationship to one another, forwardly of and adjacent to the corresponding first elongated dog and second elongated dog, the ball recesses opening rearwardly and being sized for smooth rolling receipt therein of the first and second ball bearings, respectively, and means for urging the pressure plate rearwardly toward the first elongated dog and the second elongated dog to thereby retain the first and second ball bearings in rollable engagement with the first elongated groove and the second elongated groove, respectively.

6. The basketball goal of claim 5, wherein the means for urging the pressure plate rearwardly is a coil spring and a rod positioned coaxially within the coil spring, the rod having first and second threaded ends, the first threaded end of the rod adjustably centrally penetrating the pressure plate at a point substantially equidistant between the first and second ball recesses, the second threaded end of the rod being directed horizontally forwardly from the pressure plate, a spring end cup penetrated by the second end of the rod, and an adjustment nut threadably engaged to the second end of the rod outwardly of the spring end cup to thereby permit adjustment by movement of the adjustment nut of pressure via the coil spring on the pressure plate to alter the amount of force which must be imposed upon the rim to cause release of the latching means and resultant tilting of the rim, to thereby prevent damage to the basketball goal and the backboard upon which it is mounted.

7. The basketball goal of claim 1, wherein the means for pivotally connecting the rigid metal plate to the mounting bracket includes first and second flanges which depend from opposed sides of the rigid metal plate and the mounting bracket has first and second side walls which depend parallel to each other from the top wall from opposed sides of the top wall, inwardly of and adjacent to corresponding flanges of the rigid metal plate, each of the first and second side walls of the mounting bracket having a shaft bearing fixed to an inner surface thereof, the shaft bearings being located opposite one another, forwardly and upwardly on the inner surfaces of the first and second sides of the mounting bracket, and further comprising a pivot shaft having first and second opposed ends, the first end being rotatably journaled within the first shaft bearing and the second end being rotatably journaled in the second shaft bearing, the first and second ends of the pivot shaft rotatably penetrating and terminating outwardly of the first and second opposed depending flanges of the rigid metal plate, to thereby permit the rigid metal plate and the rim fixed thereto to remain connected to the mounting bracket, and thus to the backboard, while pivoting on the pivot shaft.

8. The basketball goal of claim 1, wherein the means for causing immediate return of the rim to the normal horizontal play position after the latching means has been released and the force causing such release has been removed comprises rod and coil spring assemblies mounted to the lower surface of the top wall of the mounting bracket and connected to the rigid metal plate by central shafts which penetrate therethrough and engage the rigid metal plate, to thereby urge the rigid metal plate back to the normal horizontal position immediately after the latching means has been released.

9. A basketball goal for use with a basketball backboard having a front surface, the basketball goal comprising a rigid annular rim which is normally disposed horizontally during play, a rigid metal plate fixed to the rigid annular rim and extending rearwardly therefrom in coplanar relationship thereto, a mounting bracket having at least a back wall and a top wall mounted on the front surface of the backboard by the back wall and pivotally connected to the rigid metal plate, means for pivotally connecting the rigid metal plate to the mounting bracket to thereby permit the rigid metal plate and rigid annular rim fixed thereto to pivot in relation to the backboard, releasable latching means connected to the rigid metal plate and connected to the mounting bracket, and which permits tilting of the rigid annular rim from the normally horizontal play position thereof only when force of at least a certain preselected amount is placed upon the rigid annular rim, means for connecting the releasable latching means to the rigid metal plate, means for connecting the releasable latching means to the mounting bracket, and means for causing immediate return of the rigid annular rim to the normal horizontal play position after the latching means has been released and the force causing such release has been removed, wherein the rigid metal plate has a lower surface and the top wall of the mounting bracket extends horizontally outwardly relative to the front surface of the backboard upon which the mounting bracket is mounted and parallel and beneath the lower surface of the rigid metal plate in the normally horizontal position thereof, the top wall of the mounting bracket defining an opening for passage therethrough of a portion of the latching means when the rigid annular rim is caused to tilt from its normally horizontal play position, and further wherein the means for connecting the releasable latching means to the rigid metal plate includes at least a first bracket and a second bracket fixed to and depending from the lower surface of the rigid metal plate in transversely spaced-apart relationship to each other and extending downwardly through the opening defined by the top wall of the mounting bracket when the rigid annular rim is in the normal horizontal play position, and further wherein the first bracket and the second bracket depending from the rigid metal plate each define an opening, the opening in the first depending bracket and the opening in the second depending bracket being aligned with one another and sized for reception of a shaft, the latching means including a shaft received in the openings defined by the first depending bracket and the second depending bracket and extending therebetween, and a first elongated dog and a second elongated dog each having a first end and a second end, the first end of each dog being directed generally upwardly and the second end of each dog being directed generally downwardly, the shaft pivotally journalling in the respective first ends of the first dog and the second dog, whereby the first elongated dog and the second elongated dog depend from and pivot freely upon the shaft received in the openings defined by first depending bracket and the second depending bracket when the rigid plate and the rim to which it is fixed tilt, the first elongated dog and the second elongated dog each being provided with an elongated longitudinal groove on respective forwardly facing sides thereof, and the releasable latching means further comprising first and second ball bearings rollably engaging the first elongated groove and the second elongated groove, respectively, and a pressure plate adjustably disposed forwardly of the first elongated dog and the second elongated dog, transversely in relationship thereto, the pressure plate having first and second ball recesses formed in a dog-facing side thereof in transversely spaced apart relationship to one another, forwardly of and adjacent to the corresponding first elongated dog and second elongated dog, the ball recesses opening rearwardly and being sized for smooth rolling receipt therein of the first and second ball bearings, respectively, and means for urging the pressure plate rearwardly toward the first elongated dog and the second elongated dog to thereby retain the first and second ball bearings in rollable engagement with the first elongated groove and the second elongated groove, respectively.

10. The basketball goal of claim 9, wherein the first elongated dog and the second elongated dog each have formed transversely on elongated, mounting bracket-facing sides thereof a detent recess for reception therein of a detent shaft, and further comprising a U-bracket horizontally fixed at a base thereof to the mounting bracket, the arms of the U-bracket opening outwardly therefrom and a detent shaft transversely fixed at opposed ends thereof to and within corresponding opposed arms of the U-bracket, spaced downwardly from the top wall of the mounting bracket and forwardly from the back wall of the mounting bracket sufficiently far in each direction so as to engage the detent recess formed in each of the first and second elongated dogs when the rigid plate and the rim fixed thereto are in normal horizontal position.

11. The basketball goal of claim 9, wherein the means for urging the pressure plate rearwardly is a coil spring and a rod positioned coaxially within the coil spring, the rod having first and second threaded ends, the first threaded end of the rod adjustably centrally penetrating the pressure plate at a point substantially equidistant between the first and second ball recesses, the second threaded end of the rod being directed horizontally forwardly from the pressure plate, a spring end cup penetrated by the second end of the rod, and an adjustment nut threadably engaged to the second end of the rod outwardly of the spring end cup to thereby permit adjustment by movement of the adjustment nut of pressure via the coil spring on the pressure plate to alter the amount of force which must be imposed upon the rim to cause release of the latching means and resultant tilting of the rim, to thereby prevent damage to the basketball goal and the backboard upon which it is mounted.

12. The basketball goal of claim 9, wherein the means for pivotally connecting the rigid metal plate to the mounting bracket includes first and second flanges which depend from opposed sides of the rigid metal plate and the mounting bracket has first and second side walls which depend parallel to each other from the top wall from opposed sides of the top wall, inwardly of and adjacent to corresponding flanges of the rigid metal plate, each of the first and second side walls of the mounting bracket having a shaft bearing fixed to an inner surface thereof, the shaft bearings being located opposite one another, forwardly and upwardly on the inner surfaces of the first and second sides of the mounting bracket, and further comprising a pivot shaft having first and second opposed ends, the first end being rotatably journalled within the first shaft bearing and the second end being rotatably journalled in the second shaft bearing, the first and second ends of the pivot shaft rotatably penetrating and terminating outwardly of the first and second opposed depending flanges of the rigid metal plate, to thereby permit the rigid metal plate and the rim fixed thereto to remain connected to the mounting bracket, and thus to the backboard, while pivoting on the pivot shaft.

13. The basketball goal of claim 9, wherein the means for causing immediate return of the rim to the normal horizontal play position after the latching means has been released and the force causing such release has been removed comprises rod and coil spring assemblies mounted to the lower surface of the top wall of the mounting bracket and connected to the rigid metal plate by central shafts which penetrate therethrough and engage the rigid metal plate, to thereby urge the rigid metal plate back to the normal horizontal position immediately after the latching means has been released.

* * * * *

UNITED STATES PATENT AND TRADEMARK OFFICE

CERTIFICATE OF CORRECTION

PATENT NO. : 5,464,207

DATED : November 7, 1995

INVENTOR(S) : Boitano, R. A.

It is certified that error appears in the above-indentified patent and that said Letters Patent is hereby corrected as shown below:

Claim 3, Column 7, lines 9 through 10, after "journalling" delete --at opposed ends thereof--.

Signed and Sealed this

Twenty-third Day of April, 1996

*Attest:*

*Attesting Officer*

BRUCE LEHMAN

*Commissioner of Patents and Trademarks*